US005971176A

United States Patent [19]

MacDonald

[11] Patent Number: 5,971,176

[45] Date of Patent: Oct. 26, 1999

[54] DISPLAY RACK FOR STRIPS OF MATERIAL

[75] Inventor: Michael M. MacDonald, Clarkston, Mich.

[73] Assignee: Plastics Research Corporation, Flint, Mich.

[21] Appl. No.: 09/041,712

[22] Filed: Mar. 13, 1998

[51] Int. Cl.[6] ..... A47F 7/00

[52] U.S. Cl. ..... 211/189; 211/60.1; 211/183; 211/193; 248/228.1

[58] Field of Search ..... 211/183, 193, 211/182, 189, 87.01, 60.1, 59.1, 57.1; 248/228.1, 227.4, 342, 371, 220.41, 220.42, 220.43

[56] References Cited

U.S. PATENT DOCUMENTS

| | | | |
|---|---|---|---|
| 862,372 | 8/1907 | Alexander | 248/228.1 X |
| 2,614,268 | 10/1952 | Davies | 248/228.1 X |
| 4,027,799 | 6/1977 | Stucker | 248/220.42 X |
| 4,700,917 | 10/1987 | Dillman | 248/227.4 |
| 5,009,334 | 4/1991 | Bodkins | 248/220.41 X |
| 5,322,175 | 6/1994 | Nobili | 211/183 |

*Primary Examiner*—Robert W. Gibson, Jr.
*Attorney, Agent, or Firm*—Brooks & Kushman P.C.

[57] ABSTRACT

A display rack supported by a primary rack is disclosed. The display rack may include an I-beam connector for connecting the display rack to the bottom of an I-beam of the primary rack. Alternatively, the display rack may include an extension which has holes for receiving fasteners that are used to secure the display rack 10 to a primary rack. The display rack includes an end plate secured to a distal end of a center support. The center support has a connector at its proximal end for connection to the primary rack. A lateral support element is connected to the center support and the end plate. The lateral support element preferably includes right and left side portions and a transverse portion. The transverse portion extends parallel to the end plate while right and left side portions are parallel to one another to provide lateral support for strips of material retained in the display rack.

8 Claims, 2 Drawing Sheets

DISPLAY RACK FOR STRIPS OF MATERIAL

TECHNICAL FIELD

The present invention relates to display racks that are connected to a primary rack.

BACKGROUND ART

Point of sale merchandise displays attract consumers' interest in products and can increase sales. Large products sold in building supply, nursery supply, and warehouse-type stores are displayed on large racks or horizontal shelves. Such racks or shelves are used to store and display large sheet form items such as paneling, lattice sections, and other products that are frequently sold with associated parts. For example, decorative lattice used in gardens and on houses are designed to be assembled with trim strips or moldings as an integrated system. Standard racks used to hold large lattice sections are generally stored with other similar sheet form products such as wallboard, plywood, and paneling. It is inefficient to use large shelving units for the display of thin trim strips and joining strips that are frequently displayed in a vertically oriented rack some distance from the lattice sections.

This creates a problem for consumers who would like to purchase an integrated system but have to select parts from multiple locations within a store. This is also a problem for retailers who must advise consumers as to the location of the related parts and may lose sales if the consumers do not purchase all of the parts in the combined system.

These and other problems are addressed by the present invention as summarized below.

SUMMARY OF THE INVENTION

According to the present invention, a display rack is supported by a primary rack for displaying strips of material that are related to products displayed on the primary rack. The display rack includes a center support having a connector at a proximal end for connecting the display rack to the primary rack. An end plate is secured to a distal end of the center support. A lateral support element is connected to the center support and the end plate.

According to another aspect of the invention, the center support of the display rack has a lower leg extending from the distal end to an angled leg that extends at an oblique angle relative to the lower leg to a point where the lateral support is connected to the center support. The angled leg may extend beyond the point where the lateral support is connected to the center support to the connector. The connector may be an extension of the center support extending at an oblique angle relative to the angled leg and generally parallel to the lower leg. Alternatively, the connector may be an I-beam clamp that is adapted to be connected to an I-beam support of the primary rack.

According to another aspect of the invention, the lateral support member may be formed from rod stock to have right and left side portions extending parallel to the center support with a transverse portion connecting the right and the left side portions and the center support. The transverse portion preferably extends parallel to the end plate.

According to yet another aspect of the invention, an I-beam connector having a body portion with right and left reversely turning flanges on opposite lateral sides of the body portion is provided. The I-beam connector is adapted to be attached to the bottom of an I-beam of the primary rack. The I-beam connector preferably has a tapped hole in at least one of the reversely turned flanges. A thumb screw, or other fastener, is received in the tapped hole to lock the I-beam connector onto the primary rack.

According to a further aspect of the invention, the connector may be an extension of the center support. In this embodiment, the extension preferably has holes formed through the extension that are adapted to receive a fastener used to secure the extension to the primary rack.

These and other features and advantages of the present invention will be better understood upon review of the attached drawings in light of the following detailed description of the invention.

DETAILED DESCRIPTION OF THE PREFERRED EMBODIMENT

Figure 1:
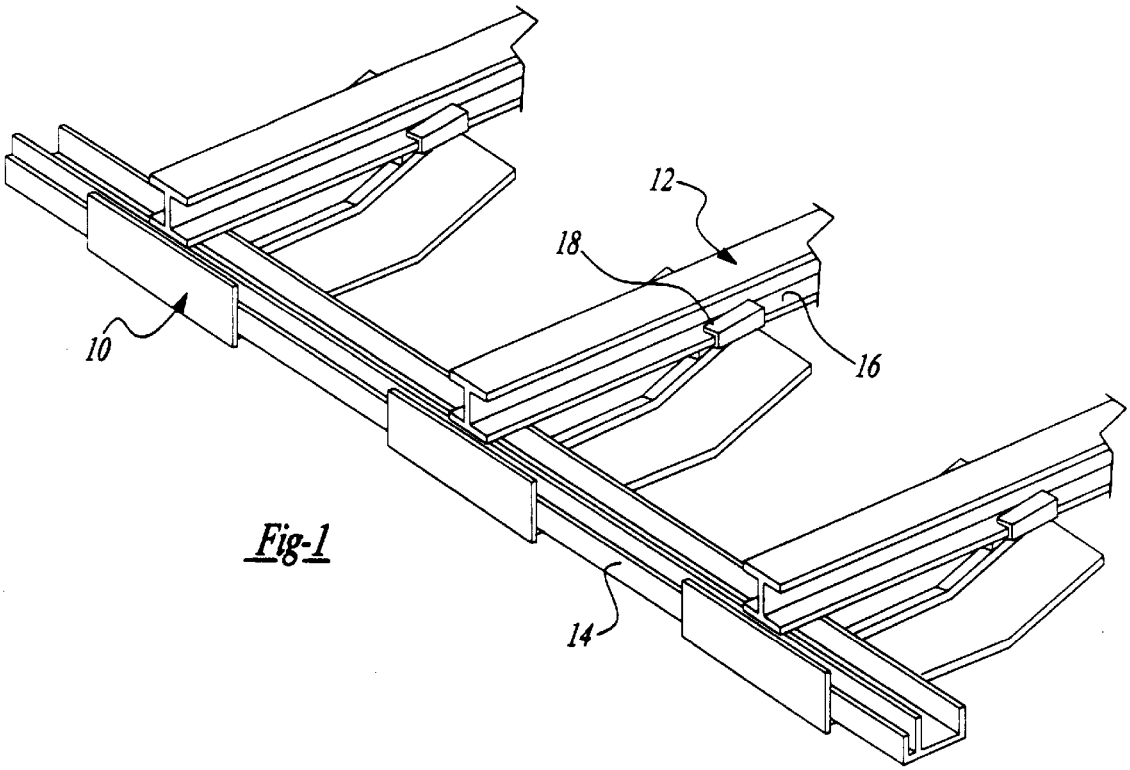
FIG. 1 is a perspective view of the display rack of the present invention secured to parallel I-beams of a primary rack.

Referring now to FIG. 1, a display rack 10 made in accordance with the present invention is shown connected to a primary "I-beam" rack 12. Strips 14 of elongated material, preferably of a type that is associated or to be sold or displayed with sheet form products displayed on the primary rack 12, are shown stored in the display rack 10. An I-beam support 16 forms a portion of the primary I-beam rack 12 to which an I-beam connector 18 of the display rack 10 is secured.

Figure 2:
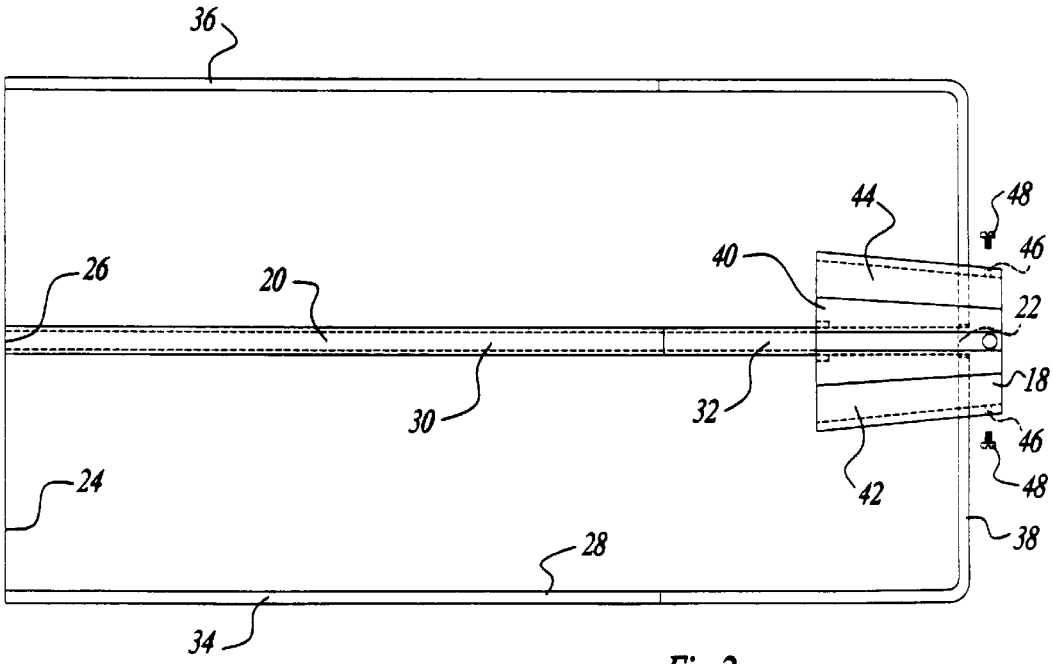
FIG. 2 is a top plan view of the I-beam rack connector embodiment of the display rack of the present invention.
Figure 3:
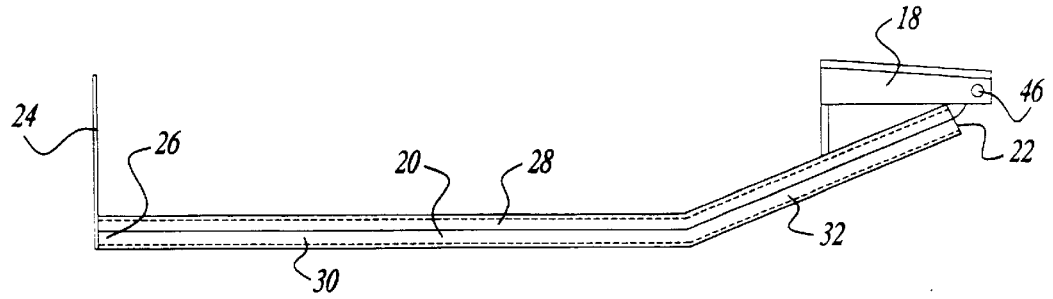
FIG. 3 is a side elevation view of the embodiment of the display rack shown in FIG. 2.
Figure 4:
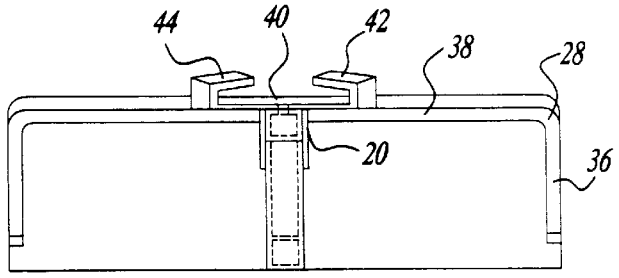
FIG. 4 is a rear elevation view of the embodiment of the display rack shown in FIG. 2.

Referring now to FIGS. 2–4, an I-beam embodiment of display rack 10 is shown in greater detail. The display rack 10 includes a center support 20 having a proximal end 22 to which the I-beam connection 18 is secured. An end plate 24 is secured in a perpendicular orientation to a distal end 26 of the center support 20. Lateral support element 28 is secured to the end plate 24 in at least one location and the center support 20 in such a way that it laterally supports strips 14 stored in the display rack 10.

The center support 20 preferably includes a lower leg 30 and an angled leg 32. Lower leg 30 extends from the end plate 24 to the angled leg 32. Angled leg 32 extends from the lower leg 30 to a point at which the lateral support element 28 is connected to the center support 20 and may extend beyond that point to the I-beam connector 18.

Lateral support element 28 is preferably formed from a steel rod and includes a right side 34 and a left side 36 that are interconnected by a transverse portion 38. Right and left sides 34 and 36 are preferably parallel to the center support 20. Transverse portion 38 is parallel to the end plate 24. When viewed in the plan view as shown in FIG. 2, the end plate 24, right side 34, left side 36 and transverse portion 38 form a rectilinear member that function to support the strips 14 in conjunction with the center support 20.

The I-beam connector 18 includes a body portion 40 and right and left reversely turned flanges 42 and 44 on opposite sides of the body portion 40. One or more tapped holes 46 are formed in one or both of the right and left reversely turned flanges 42 and 44. Thumb screws 48 are received in the tapped holes 46. Thumb screws 48 may be tightened to lock the I-beam connector 18 to the I-beam support 16. Thumb screws 48 may be loosened to reposition the display rack 10 or remove the display rack 10 from the primary I-beam rack 12.

Figure 5:
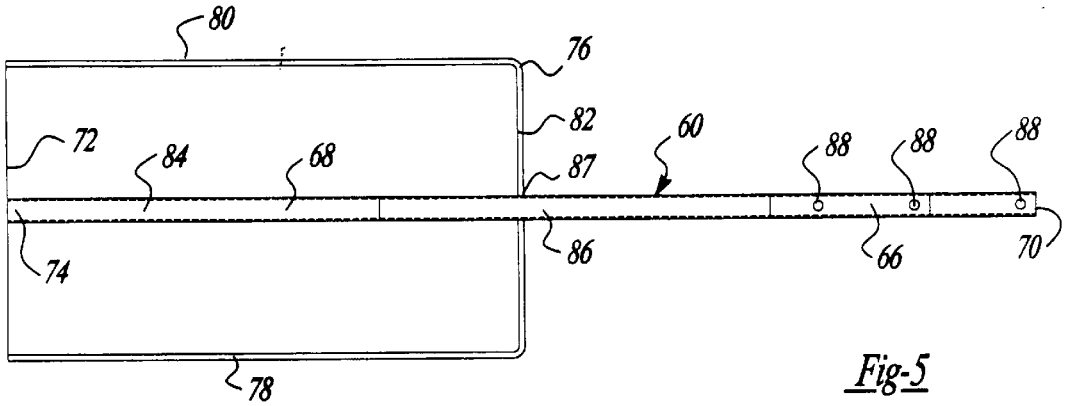
FIG. 5 is a top plan view of an alternative connector embodiment of the display rack of the present invention.
Figure 6:
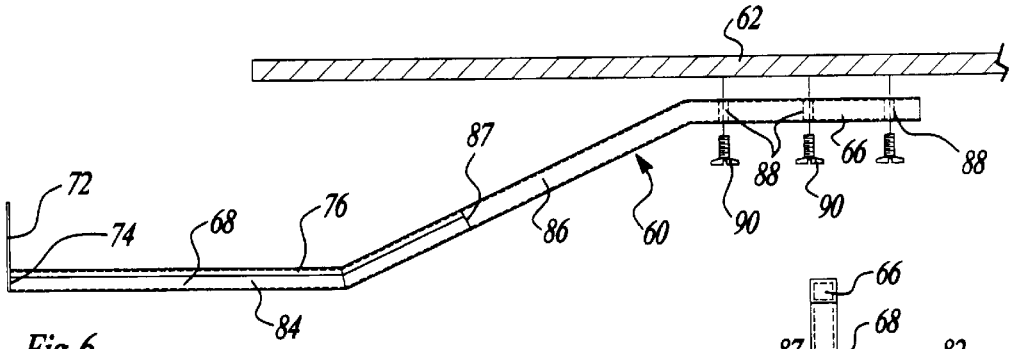
FIG. 6 is a side elevation of the embodiment of the display rack shown in FIG. 5.
Figure 7:
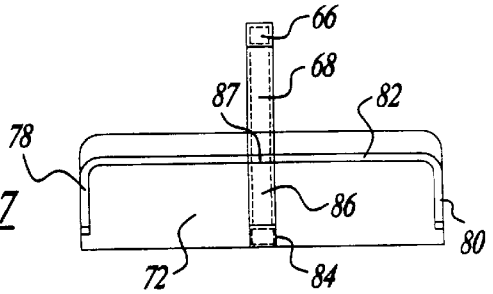
FIG. 7 is a rear elevation view of the embodiment of the display rack shown in FIG. 5.

Referring now to FIGS. 5–7, an alternative embodiment of the present invention is shown wherein a display rack 60 is provided for use with a primary horizontal rack, or H-rack, 62. The primary H-rack has horizontally extending shelves generally made of plywood or particle board. An extension 66 of the center support 68 is provided with vertically oriented holes 88 through which fasteners 90 are inserted that are used to fasten the display rack 60 to the H-rack 62.

The display rack 60 includes a center support 68 that includes extension 66 defining a proximal end 70. The display rack 60 has an end plate 72 secured perpendicularly to a distal end 74 of the center support 68. End plate 72 may be secured in a non-perpendicular orientation if desired. Lateral support element 76 includes right and left sides 78 and 80 and a transverse portion 82 that are preferably formed in one piece from a single steel rod. The center support 68 includes a lower leg 84 which extends from the end plate 72 to an angled leg 86. Angled leg 86 extends beyond the connection point 87 with the transverse portion 82 of the lateral support element 76 to the extension 66. Angled leg 86 extends at an oblique angle relative to the lower leg 84 and at an oblique angle relative to the extension 66. Lower leg 84 and extension 66 are preferably substantially parallel but may be somewhat angled relative to each other.

Extension 66 includes a plurality of holes 88 that extend vertically through the extension 66. Fasteners 90 are preferably provided that extend through holes 88 and are secured to the primary H-rack 62.

The preceding description of two preferred embodiments of the present invention are provided by way of example and are not intended to be read in a limiting sense. The broad scope of the present invention should be construed by reference to the following claims.

What is claimed is:

1. A display rack supported by a primary rack for displaying strips of material comprising:

a center support having a connector at a proximal end;

an end plate secured to a distal end of the center support;

a lateral support element connected to the center support and the end plate; and said center support having a lower leg extending from the distal end to an angled leg that extends at an oblique angle relative to the lower leg to a point where the lateral support is connected to the center support.

2. The display rack of claim 1 wherein said angled leg extends beyond the point where the lateral support is connected to the center support to the connector.

3. The display rack of claim 2 wherein said connector is an extension of the center support extending at an oblique angle relative to the angled leg and generally parallel to the lower leg.

4. The display rack of claim 2 wherein said connector is an I-beam clamp.

5. A display rack supported by a primary rack for displaying strips of material comprising:

a center support having a connector at a proximal end;

an end plate secured to a distal end of the center support;

a lateral support element connected to the center support and the end plate; and said lateral support member being formed from a rod, right and left side portions extending parallel to the center support, and a transverse portion connecting the right and left side portions and the center support, said transverse portion extending parallel to the end plate.

6. A display rack supported by a primary rack for displaying strips of material comprising:

a center support having a connector at a proximal end;

an end plate secured to a distal end of the center support;

a lateral support element connected to the center support and the end plate; and said connector further comprising an I-beam connector having a body portion having right and left reversely turned flanges on opposite lateral sides of the body portion, said I-beam connector being adapted to be attached to a bottom of an I-beam of the primary rack.

7. The display rack of claim 6 wherein the I-beam connector has a tapped hole in at least one of the reversely turned flanges, and wherein a thumb screw is received in the tapped hole to lock the I-beam connector onto the primary rack.

8. A display rack supported by a primary rack for displaying strips of material comprising:

a center support having a connector at a proximal end;

an end plate secured to a distal end of the center support;

a lateral support element connected to the center support and the end plate; and said connector further comprising an extension of the center support having holes formed through the extension that are adapted to receive fasteners that are secured to shelves of the primary rack.

* * * * *